US008208667B2

(12) United States Patent
Sörgel et al.

(10) Patent No.: US 8,208,667 B2
(45) Date of Patent: Jun. 26, 2012

(54) INDIVIDUALLY ADJUSTABLE HEARING AID AND METHOD FOR ITS OPERATION

(75) Inventors: Wolfgang Sörgel, Erlangen (DE); Andreas Tiefenau, Nürnberg (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 984 days.

(21) Appl. No.: 12/228,411

(22) Filed: Aug. 12, 2008

(65) Prior Publication Data

US 2009/0046878 A1 Feb. 19, 2009

(30) Foreign Application Priority Data

Aug. 13, 2007 (DE) ..... 10 2007 038 191

(51) Int. Cl.
*H04R 25/00* (2006.01)

(52) U.S. Cl. ..... 381/318; 381/314

(58) Field of Classification Search ..... None
See application file for complete search history.

(56) References Cited

U.S. PATENT DOCUMENTS

| | | | | |
|---|---|---|---|---|
| 4,759,070 | A * | 7/1988 | Voroba et al. | 381/60 |
| 5,604,812 | A * | 2/1997 | Meyer | 381/314 |
| 6,035,050 | A * | 3/2000 | Weinfurtner et al. | 381/313 |
| 6,829,363 | B2 * | 12/2004 | Sacha | 381/315 |
| 7,082,205 | B1 * | 7/2006 | Westermann | 381/312 |
| 8,107,635 | B2 * | 1/2012 | Ludvigsen | 381/60 |
| 2007/0282393 | A1 * | 12/2007 | Marquis | 607/55 |
| 2008/0112583 | A1 | 5/2008 | Kornagel | |
| 2008/0144866 | A1 * | 6/2008 | Barthel et al. | 381/314 |
| 2008/0260171 | A1 * | 10/2008 | Nordahn et al. | 381/60 |

FOREIGN PATENT DOCUMENTS

| | | | |
|---|---|---|---|
| DE | 10064210 | A1 | 7/2002 |
| DE | 101 52 197 | A1 | 5/2003 |
| DE | 10 2005 009 530 | B3 | 8/2006 |
| EP | 0 814 634 | B1 | 10/2002 |
| EP | 1 453 356 | A2 | 9/2004 |
| EP | 1713302 | A1 | 10/2006 |
| WO | 03098970 | A1 | 11/2003 |
| WO | 2006074655 | A1 | 7/2006 |

* cited by examiner

*Primary Examiner* — Hoang-Quan Ho

(57) ABSTRACT

The invention relates to an adjustable hearing aid to which at least one parameter which influences the response and amplification characteristics of the hearing aid can be adjusted, with means being included which carry out testing of the effectiveness of an adjustment of this parameter in the prevailing auditory situation, and means being included which, given the existence of a minimum effectiveness, enable the adjustment option of this parameter.

17 Claims, 3 Drawing Sheets

INDIVIDUALLY ADJUSTABLE HEARING AID AND METHOD FOR ITS OPERATION

CROSS REFERENCE TO RELATED APPLICATIONS

This application claims the benefits of German application No. 10 2007 038 191.5 filed Aug. 13, 2007 and is incorporated by reference herein in its entirety.

FIELD OF INVENTION

The invention relates to an individually adjustable hearing aid, in particular with individually adjustable noise suppression, and a method for its operation.

BACKGROUND OF THE INVENTION

Hearing aids serve primarily to enable patients with hearing impairment to achieve as natural a perception of sound as possible and, to that end, generally to compensate for medically-based functional disturbances of the organs of hearing. It is intended that this should be brought about as conveniently as possible and without appreciable disadvantage to the hearing aid wearer. Accordingly, the functional spectrum of hearing aids includes simple sound pressure amplifying devices and/or prosthetic devices for prosthetic support of stimulus generation in the interior of the ear. Regardless of the embodiment, the hearing aid used will always have the function of converting incident sound pressure into auditory stimuli for the hearing aid wearer like those that would also occur with physiologically and anatomically intact hearing organs. In order to meet these requirements, numerous subjective factors relating to the individual hearing aid wearer which can result from the individual quality of his/her hearing impairment and also the selectivity of his/her perception must be taken into account.

Modern hearing aids therefore allow a plurality of parameters which influence the response and amplification characteristics of the hearing aid used to be adjusted. The adjustment of these parameters usually takes place during manufacturing in the form of a basic setting, which can subsequently be adapted to the patient in the form of fine tuning during one or more sessions with a hearing aid acoustician. It is self-evident that fine tuning of this type is associated with a substantial degree of effort on the part of the patient and the hearing aid acoustician involved and that it can mean a substantial loss of convenience, at least for the patient.

The problem addressed applies to a particularly large extent when the individually adjustable parameters simultaneously form the input variables of complex signal processing algorithms which, in turn, influence the response and amplification characteristics of the hearing aid used. In modern hearing aids, several such algorithms, for example, for suppressing noise and for accentuating desired signal sources are implicit. Examples are (adaptive) directional microphones, algorithms for damping non-speech components, for rapid spectral noise estimation/Wiener filtering, for wind noise suppression or signal envelope-based suppression of transient noise, to name only a few. The potential efficiency of these algorithms is usually adjustable by means of various parameters, although the actual effect depends, apart from this parameterizing, also on the incident sound input signal and the hearing situation represented thereby. The parameterizing of various noise reduction algorithms has also previously been undertaken statically when the hearing aid was adjusted by a hearing aid acoustician. Starting from a presetting undertaken by the manufacturer, this involves the making of manual settings adjustments by the acoustician. Fine tuning of this type can be undertaken in several steps and is also relatively complex. Furthermore, the decision as to which parameters are to be adapted to which algorithm is very difficult to make under laboratory conditions, since the subjective requirements of the hearing aid wearer only become apparent in real auditory situations.

Various possibilities for being able to undertake at least part of the adjustment and/or fine tuning of the hearing aid independently of a hearing aid acoustician are known and, in the ideal case, this is carried out by the hearing aid wearer/patient himself. This type of subsequent adaptation of a hearing aid at any time is possible only to a limited extent. On the one hand, the adjustability of relevant parameters must be prepared technically, which frequently requires an acoustics laboratory, at least in the conception phase and can only be performed under simulated conditions. On the other hand good adaptation to actual auditory situations, particularly with high convenience hearing aids, is partly associated with the adaptation of numerous technical parameters, which can either involve a long-winded search for optimum parameters and/or possibly overstretch the technical knowledge of lay persons, particularly as far as the selection of the relevant parameters and/or algorithms in a given auditory situation is concerned.

It is known to reduce the effort required for external adjustment/fine tuning of a hearing aid in that a real auditory situation is classified, and this enables subsequent allocation of the classified auditory situation to a plurality of saved data records with preset parameters. In this case, it is only the selection of the set of parameters which best match the respective auditory situation that is carried out interactively (EP 0 814 634 B1). However, this procedure requires the storage of a relatively large number of data sets with preset parameters in order to be able to make a finely stepped selection of the suitable parameter set.

It is also known, based on stored preset parameters and the classification of a particular auditory situation, to offer parameter sets which are automatically varied once they have been selected by the hearing aid wearer (EP 1 453 356 A2). However, with automated parameter variation to be defined in advance, it is difficult to undertake optimum adaptation to auditory situations which cannot be predicted in advance if no suitable parameter set is available and/or no suitable parameter variation has been prepared.

It is also known to group together sequences of program steps that are required for adapting a hearing aid to particular auditory situations into macros in order to facilitate their repetition (DE 101 52 197 A1). However, the problem of possible high complexity on first performance of the relevant program steps remains in place.

It is also known, starting from stored preset parameters and the classification of a particular auditory situation, to offer parameter sets which are varied by the hearing aid wearer and then stored and allocated to the classified auditory situation (DE 102005 009 530 B3). The complexity of the parameter variation that has to be carried out remains in hearing aids of this type, however.

It is also known from DE 100 64 210 A1, in order to adapt a hearing aid, to read an electrical input signal from the hearing aid and to feed it to a processor unit for graphical representation. By this means, the effect of a change in hearing aid parameters can be displayed.

SUMMARY OF INVENTION

The object of the invention is to provide a possibility for adjusting a hearing aid easily and reliably, in particular when an adjustment of complex signal processing algorithms to a concrete situation is to be carried out.

This object is achieved with an adjustable hearing aid having the features of the claims.

The core of the invention consists therein that when a hearing aid is adjusted, only a few or only one parameter is provided which can be varied in a particular auditory situation. For this purpose, the person who is to adjust the hearing aid to the relevant auditory situation, in particular the hearing aid wearer himself, needs only to actuate a few, or one, adjusting element in a normal everyday situation. However, the functional scope of the hearing aid is not thereby restricted. This is achieved in that adjusting elements provided for the adjustment of the hearing aid are each linked to arrangements, in circuit terms, by means of which variation of precisely those parameters is possible whose alteration in the relevant auditory situation and/or taking account of the current settings of the adjustable parameters of the hearing aid have a particularly strong influence on the response and/or amplification characteristics of the hearing aid. The possibility of adjusting other parameters can therefore be temporarily dropped, but reinstated by changing the linking of the adjusting elements when an auditory situation arises in which the suitability or necessity for the variation of one or more parameters which were not previously offered for a variation of this type arises. According to the invention, a change in the linking of the adjusting elements can therefore also take place if, due to the setting of the parameter with the previously greatest influence on the response and/or amplification characteristics of the hearing aid, its adjustment to the existing auditory situation was so improved that now the adjustment of a different parameter develops a greater influence on the response and/or amplification characteristics of the hearing aid than would be the case from further fine tuning of the already well adjusted parameter that was initially varied.

Parameters in this context are all variables for which an adjustment option is provided in at least some auditory situations and which can influence the response and amplification characteristics of the hearing aid. They can also include parameter sets which are integrated in the form of parameter ensembles that are not adjustable independently of one another in algorithms for signal processing, such as are used for noise suppression for instance. Response and/or amplification characteristics of the hearing aid should be understood in this context to mean all properties of the hearing aid which can be adapted, by means of adjusting elements or other technical means, to an auditory situation and/or a customer wish with regard to acoustic and/or selective properties of the hearing aid.

The invention makes use of the determination or estimation of the effectiveness of an adjustment option that is to be carried out, in order to offer such adjustment option to a hearing aid user, depending on said effectiveness. The effectiveness of adjusting a parameter or an algorithm assumes at least one qualified change between the input signal and the output signal of this algorithm or the dependence of this change on the respectively selected setting. In general, any comparison between the input signal and the output signal may serve as a measure for its effectiveness.

In order to carry out the invention, at least one adjustable hearing aid is required in which at least one parameter that has an influence on the response and amplification characteristics of the hearing aid can be adjusted, wherein means are included which perform testing of the effectiveness of a change to this parameter in the prevailing auditory situation, and means are included which enable the adjustment option for this parameter, given at least a minimum effectiveness. Advantageously, the enabling of the adjustment option includes the linking, in circuit terms, of the adjustable parameter to a variably assignable adjusting element. Thus, if the adjusting element is actuated by the hearing aid wearer, adjustment of the parameter that is linked, at the time of the adjustment, to the adjusting element will also show a corresponding effect, since it could not be altered by means of the adjusting element if its effectiveness were lacking in a particular auditory situation. Unrecognized or poorly reproducible settings or adjustments of parameters are thereby avoided. It is therefore always defined internally in the device which parameters are changed according to the user input in order to adapt the device settings, in particular the settings of noise suppression algorithms, to the wishes of the user. Through the described establishment of the effectiveness of the individual algorithms and the exclusive alteration of the active algorithms in a given situation, an implicit situation-dependent adaptation of the noise suppression effect is achieved.

Since the setting option according to the invention of hearing aids shows its advantages, in particular, for adapting complex signal processing algorithms, the invention will now be described paying particular attention to the adaptation of algorithms for noise suppression, but without limiting it exclusively to these applications.

Since different hearing aid wearers often prefer different levels of effectiveness of the noise suppression or the individual algorithms integrated into their hearing aid for noise suppression, depending on the ambient situation, simple and unambiguous selection of the parameters for adapting these algorithms in the form of a default setting following recognition and/or classification of an auditory situation is difficult. The necessity remains for adaptation, in the process of which the hearing aid wearer can allow his/her preferences be input into the settings for the algorithms for noise suppression in respective concrete situations. This can be achieved, according to the invention, by means of a simple interface which reduces the complexity of the setting procedure and can be formed with adjusting elements linked according to the invention.

In this case, the settings are undertaken step-by-step and one after the other, wherein a continuous improvement takes place in the adaptation of the hearing aid to the respective prevailing auditory situation, whereas a worsening in the adaptation by the making of faulty settings is substantially precluded. This facilitates the finding of situation-dependent settings for different algorithms, in particular for algorithms for noise suppression, which are optimally adapted to the individual needs of the hearing aid wearer in the respective auditory situation. The possibility is offered to the hearing aid wearer to adapt the effect of the noise suppression by means of the user interface according to the invention to his/her preferences in the prevailing ambient situation without having to concern himself in detail with the mode of operation of the different algorithms and having to make a selection decision.

Advantageously, a protocol of the adjustments made and of the values of the adjustable parameters set, and preferably also the effectiveness of different algorithms, in particular those for noise suppression, is recorded. This protocol can be used to enable, by means of a learning algorithm, continuous improvement of automatic adaptation of the hearing aid to changing auditory situations and the preferences of the hearing aid wearer. For this purpose, it is advantageous when an auditory situation is analyzed and/or classified, if adjustable parameters which influence the response and/or amplification characteristics of the hearing aid are initially set to starting values belonging to this auditory situation and subsequently adjusted once testing of the effectiveness of the adjustments in the existing auditory situation has been carried out and, given a minimum effectiveness, the adjustment options of the parameters which are distinguished by having a minimum effectiveness, have been enabled. The danger that faulty settings will be made is also low in this case, since the effectiveness testing which takes place before the adjustment prevents unrecognized or poorly reproducible adjustments of parameters. In particular, when adjustments to the parameters that have been made are recorded and the settings of the parameters are later used as starting values to which the adjustable parameters are set, when at a later time point an auditory situation is recognized which is characterized by similar acoustic features or a similar classification, the user input serves to enable situation-dependent learning of the settings preferred by the hearing aid wearer. In frequently occurring auditory situations, manual adjustment of the parameters gradually becomes superfluous, since following recognition of the auditory situation, the optimal parameter set is predetermined automatically.

Adaptation of the parameters can take place either instantaneously or smoothed over time. The result of this learning process is stored in the hearing aid and is available after switching the hearing aid off and on again. By this means, continuous adaptation to the setting preferred by the user is possible until an optimum approximation has been reached and no further change seems necessary.

The invention offers a series of advantages. On the one hand, hearing aids can be easily tuned by the user to his/her needs in a targeted manner in complex auditory situations that are difficult for lay persons to assess. In auditory situations that are difficult to assess, the invention can provide the possibility of allowing a hearing aid to be set faultlessly by a lay person, preferably the hearing aid wearer.

The hearing aid is necessarily set here in a situation-dependent manner, since only those parameters whose influence is adjudged to be audible are adjusted. Other parameters remain at the existing values, which can be offered, for example, in the form of pre-set values, thereby reducing the risk of erroneous settings. Setting of the hearing aid can also be undertaken in complex auditory situations via a simple interface, for example, in the form of a single one-dimensional adjusting element. An adjusting element of this type may comprise a simple rotary regulator or plus/minus buttons, for example, on a remote control unit which communicates with the hearing aid.

On the other hand, very effective optimization of the hearing aid in different auditory situations can be achieved by the use of learning algorithms, already rendering further interaction on the part of the hearing aid wearer superfluous after a short training phase. One advantage of the invention consists therein that learning algorithms used also only influence parameters that are assessed as being effective in a particular auditory situation and are therefore adjustable, thus making it easier to avoid faulty parameter inputs in particular auditory situations. For example, in a prevailing auditory situation, no algorithms for noise suppression which are ineffective in this auditory situation can be accidentally changed.

BRIEF DESCRIPTION OF THE DRAWINGS

The invention is described in greater detail with reference to exemplary embodiments, in which.

DETAILED DESCRIPTION OF INVENTION

Figure 1:
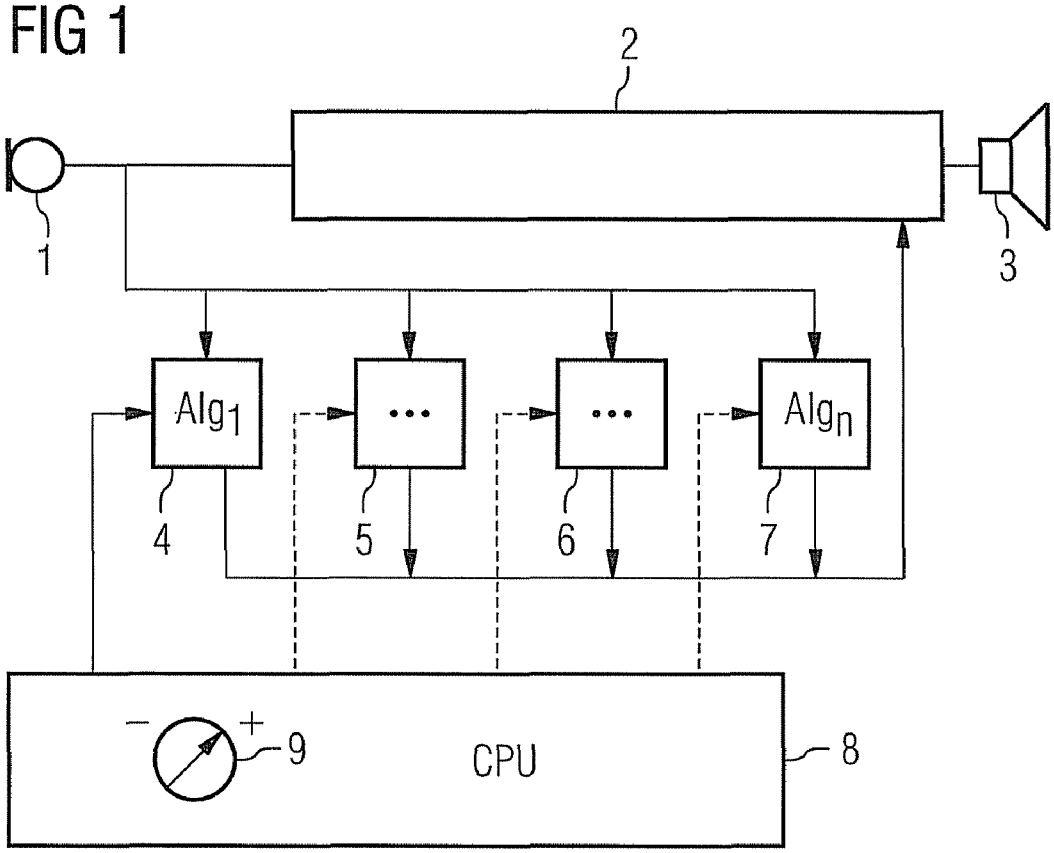
FIG. 1 shows a schematic representation of a hearing aid according to the invention.

FIG. 1 shows a schematic representation of a hearing aid according to the invention. It comprises a signal transfer route which comprises an input unit 1 in the form of a microphone, a signal processing and/or amplification unit 2 and an output unit 3 in the form of a loudspeaker. Signals arriving at the microphone can be passed on in a pre-determined manner amplified, for example, non-linearly, to the output unit 3. Further signal processing units 4, 5, 6, 7 are also included in which incoming signals can be altered by a particular algorithm before they are passed on to the signal processing and/or amplification unit 2, and flow into the signal applied to the output unit 3. Furthermore, the further signal processing units 4, 5, 6, 7 can be configured as hardware, separately or as a component of the signal processing and/or amplification unit 2 and/or purely in the form of the provision of suitable signal-processing software. This can be left out of consideration for the functioning of the hearing aid according to the invention. The different algorithms in the signal processing units 4, 5, 6, 7 can, for example, comprise algorithms for noise suppression, but can also involve every other type of signal processing that is striven for in hearing aids. In order to be able to influence the effectiveness of the algorithms obtained, setting options are provided by means of which one or more parameters on which the effectiveness of the respective algorithm depends can be varied. Furthermore, a linking element 8 is included which can carry out linking of individual signal processing units 4, 5, 6 or 7 with an adjusting element 9. This linkage is carried out after assessment of the effectiveness of the algorithms acting in the respective signal processing units 4, 5, 6 and 7 and depending thereon. The linking element 8 comprises the means required for assessing the effectiveness of the algorithms acting in the respective signal processing units 4, 5, 6 and 7. For example, in the embodiment shown, this means that the algorithm $Alg_1$ contained in the signal processing unit 4 was determined as being the algorithm with the greatest effectiveness in a prevailing auditory situation and only this algorithm can be influenced or optimized in its effectiveness by the adjusting element 9, since the linkages between the adjusting element 9 and the other signal processing units 5, 6 and 7 (shown dashed) are interrupted at this time.

Determination of effectiveness can be carried out in various ways. In a recognized or classified auditory situation, which can always be described through particular spectra, it is possible, by using various models that describe the effect of the parameters and/or algorithms to be set, to simulate their effect or the results of an adjustment on the amplification and response characteristics of the hearing aid in the recognized or classified auditory situation and to calculate the effectiveness within the context of the invention by comparing the simulated input signals and the simulated output signals. Given an efficient classification and/or recognition system and suitably frequently occurring auditory situations, good results can be achieved by this means.

Another advantageous embodiment of the method according to the invention results if, rather than a classification attempt, real-time detection of the prevailing auditory situation is carried out and various models which describe the effects of the parameters and/or algorithms to be set are applied to input variables obtained therefrom. By this means, the effect of these parameters and/or algorithms or the effects of adjusting them on the amplification and response characteristics of the hearing aid in the actually detected or measured auditory situation can be simulated, the effectiveness within the context of the invention can be calculated by a comparison of the simulated input signals and the simulated output signals. A comparison of the actual auditory situation with various previously classified auditory situations can be dispensed with in this case, thus avoiding most of the problems associated with recognition accuracy in the allocation of auditory situations.

The method according to the invention can be carried out entirely independently of the quality of calculation models if, instead of a simulated effect of parameters to be tested in a particular auditory situation, an actual determination of the change in an incoming signal is undertaken by means of an algorithm that is to be set. By this means, particularly precise determination of the effectiveness of a parameter and/or an algorithm for signal processing can be achieved.

Direct detection of the effectiveness of an algorithm in a particular auditory situation can be given priority at least when, from a determined effectiveness, the required effectiveness of an adjustment of a parameter of this algorithm that is to be carried out is simultaneously concluded, in order to enable this adjustment option by its linking according to the invention to an adjusting element. If, on the other hand, the effectiveness of an adjustment is to be determined, since the effectiveness of an algorithm in a particular auditory situation and setting is not itself regarded as an indicator of the effectiveness of the adjustment, model-based methods, as described above, can advantageously be used.

The individual aspects of the determination of the effectiveness of a setting or adjustment of a parameter or algorithm can advantageously be combined with each other. For example, a direct detection of the effectiveness of an algorithm in a particular auditory situation can be combined with a classification system for classification of auditory situations, wherein the actually determined effectiveness of adjustment options is linked to the respective classified auditory situation.

Determination of the effectiveness can take place either event-related at the moment of a user input, or continuously over the period before and after the user input.

Figure 2:
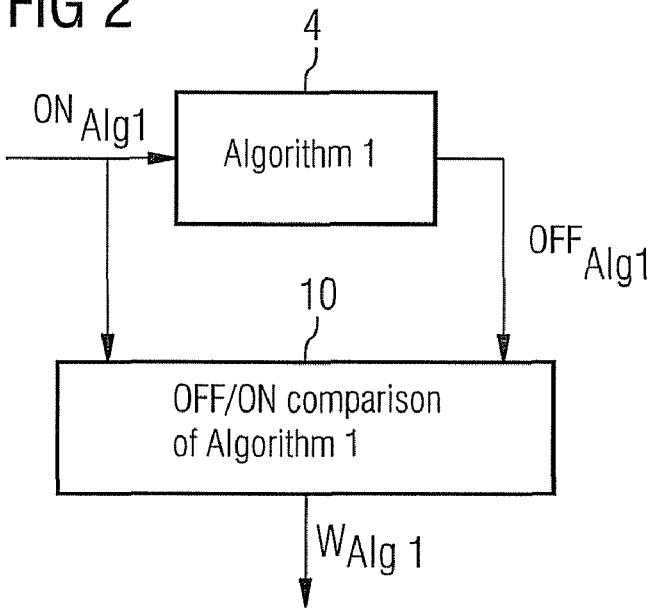
FIG. 2 shows a section of a program flow diagram used to describe the method according to the invention for operating a hearing aid according to the invention.

FIG. 2 shows a section of a program flow diagram used to describe the method according to the invention for operating a hearing aid according to the invention. Shown schematically is the determination of the effectiveness of an algorithm $Alg_1$ contained in a signal processing unit 4 in a particular auditory situation. For this purpose, an input signal which is fed to this signal processing unit 4 is simultaneously fed to a comparator unit 10 in which a comparison of this input signal with the output signal of the signal processing unit 4 is carried out once said signal has been subjected to this algorithm $Alg_1$. A parameter $W_{Alg1}$ which permits quantitative and/or qualitative estimation in the respective auditory situation of the effectiveness of the algorithm $Alg_1$ that has been run is derived from a comparison operation. The parameter designated effectiveness in the present invention can be any quantitatively detectable parameter which enables an unambiguous description of the effect that a particular algorithm has on an incoming signal during signal processing. As a measure for the effectiveness, for example, the mean amplification reduction of a channel in a defined period, for example 1 minute, before and after user input can be used. Alternatively or in addition, instantaneous values can also be evaluated in real time.

Allocation of a particular effectiveness parameter to an algorithm that is to be run for an input signal in a particular auditory situation forms a core area of the present invention. The sequence of program steps shown can be integrated singly or multiply into program sequences that are suitable for carrying out the method according to the invention, wherein both directly measured or actually applied—or, in the manner described, model-based—input and output signals can be included.

Determination of the effectiveness of signal processing algorithms and the blocking or enabling of relevant adjustment options depending thereon can also advantageously be used for the application of learning algorithms. With regard to intelligent noise suppression, this necessarily means that as a result of the respective learning algorithm, only those components of the noise suppression are considered which change the signal in the respective situation according to the estimated effectiveness. If, for example, a situation prevails in which there is no wind, the algorithm for wind noise reduction will not influence the signal and is therefore not effective. Adjustments to the algorithm for wind noise reduction are also ineffective and cannot be varied according to the invention. Therefore the learned and instantaneous setting of the wind noise reduction can remain unaltered in this concrete situation.

Figure 3:
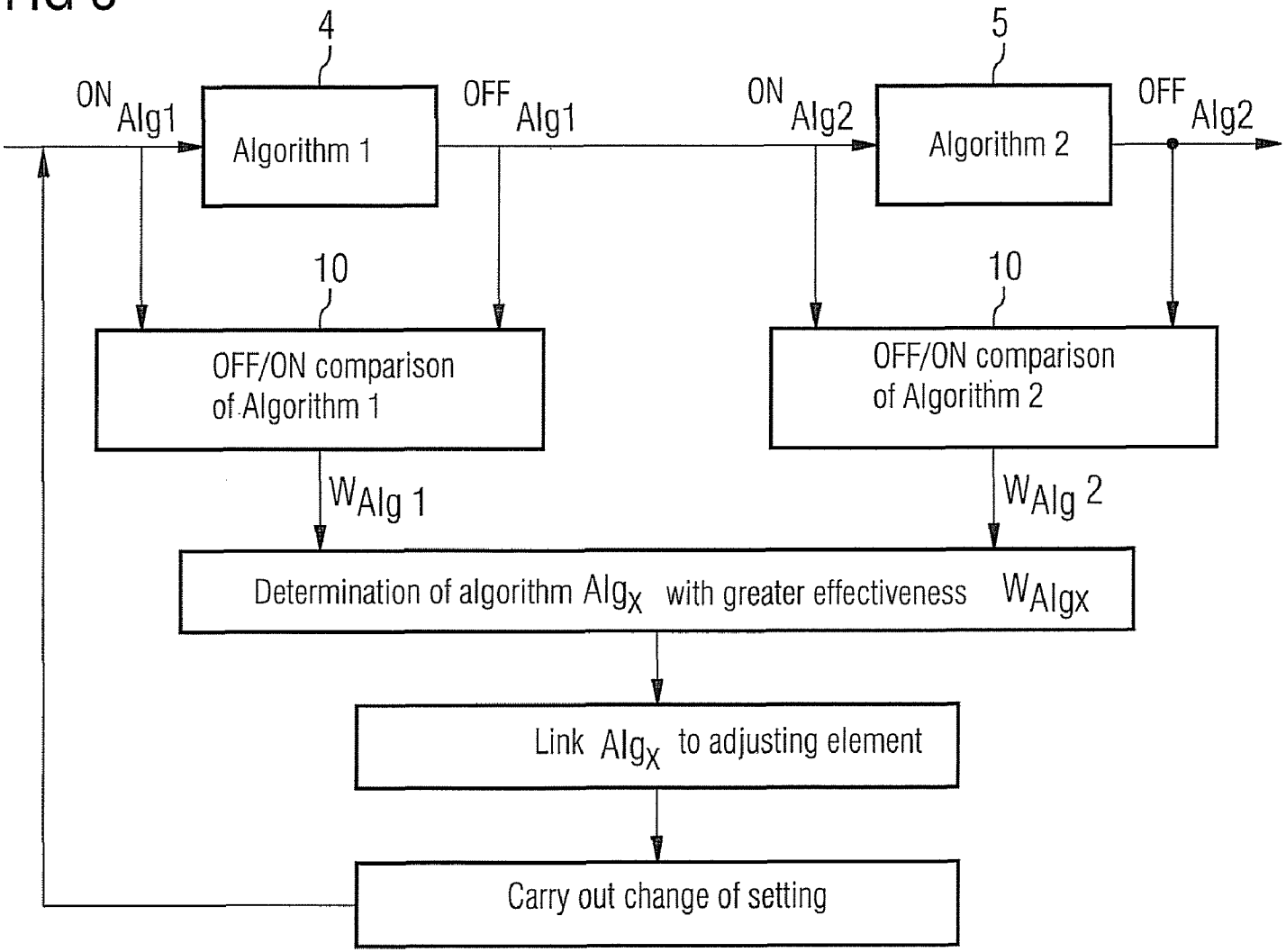
FIG. 3 shows a further section of a program flow diagram for describing the method according to the invention for operating a hearing aid according to the invention.

FIG. 3 shows a further section of a program flow diagram to describe the method according to the invention for operating a hearing aid according to the invention. An incoming signal consecutively runs through two different algorithms, for example, two algorithms for noise suppression. In parallel with the signal processing in the signal processing units 4, 5, determination of the effectiveness of the individual algorithms, as described already in FIG. 2, in a prevailing auditory situation is undertaken by means of an off/on comparison. By this means, it is made possible to determine the algorithm $Alg_x$, which has the greatest effectiveness $W_{Algx}$ in the relevant auditory situation. This algorithm is then released for further adaptation to the respective auditory situation by linking the relevant signal processing unit to an adjusting element 9, by which means the relevant adaptation can be carried out by a change in the parameters which influence the mode of action of the algorithm $W_{Algx}$. These sequences can be made to run multiple times in the form of a loop. This automatically takes into account that, as a result of possibly altered effectiveness of an algorithm due to the adjustments made, a different algorithm involved in the signal processing may be preferred for linking to the adjusting element. In this manner, adjustments of hearing aids can be made with, for example, only one adjusting element to which parameters from different algorithms are allocated consecutively as adjusting options. Through multiple actuation of an adjusting element linked in this way, easy and convenient adjustment of the hearing aid to the actual auditory situation can be undertaken without precise knowledge of the respectively set parameters.

Figure 4:
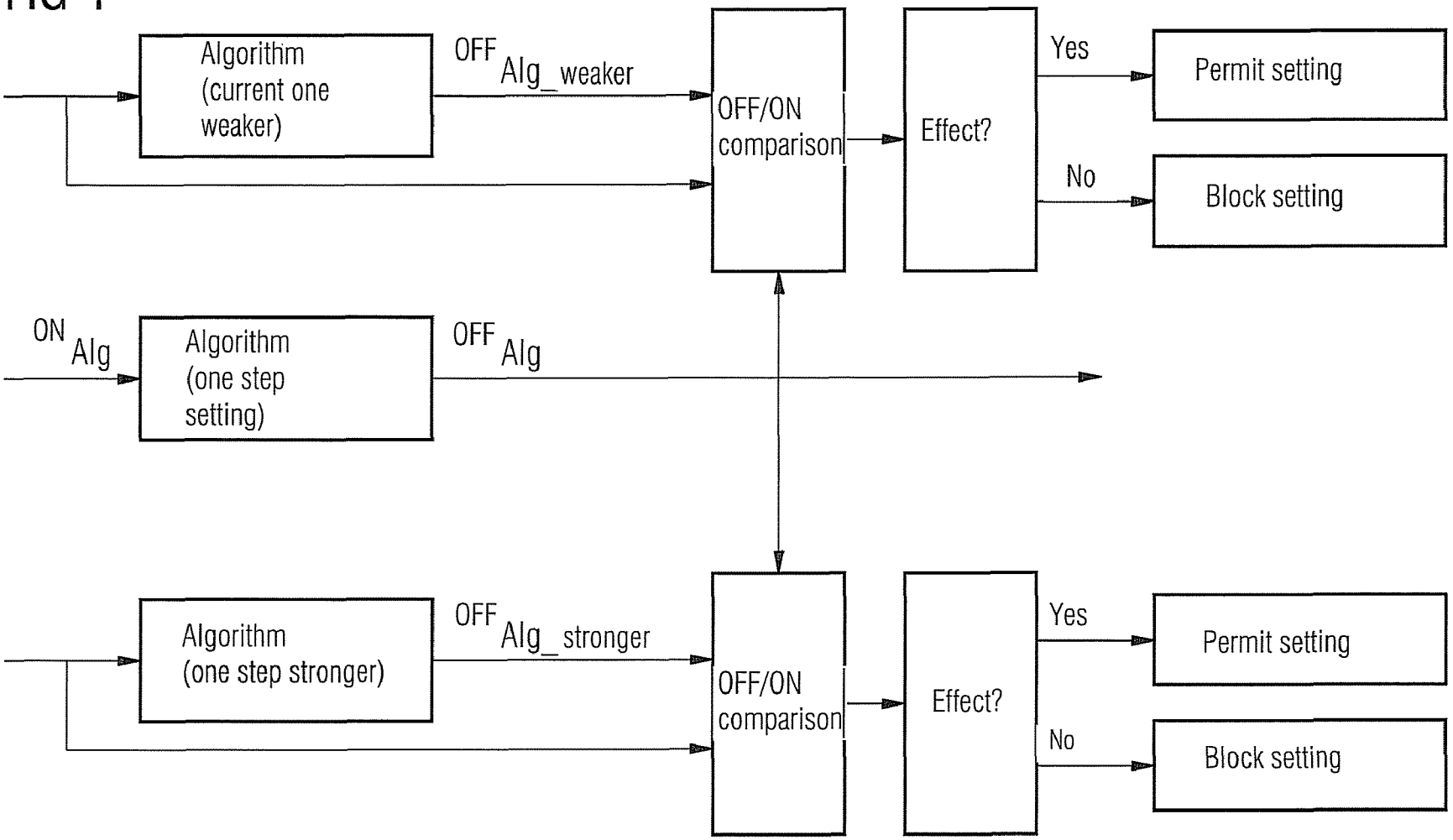
FIG. 4 shows a further section of a program flow diagram for describing the method according to the invention for operating a hearing aid according to the invention.

FIG. 4 shows another section of a program flow diagram to describe the method according to the invention for operating a hearing aid according to the invention. In this embodiment, in addition to checking the effectiveness of an algorithm and linking an adjusting element to the associated signal processing unit, the effectiveness of the adjustment of the adjusting element is checked before the adjustment is actually enabled. For this purpose, a preferably discretely adjustable parameter of an algorithm for signal processing is adjusted in order to increase or reduce the effectiveness of the algorithm that can be influenced thereby. Together with an unadjusted setting, it is always checked by means of an off/on comparison to be made in each case whether an adjustment of the relevant parameter brings about an effect or not, which corresponds to a check of whether this adjustment is associated with a minimum effectiveness. This is suitable in cases where a current setting in a particular auditory situation already results in optimum functioning or effectiveness of a signal processing algorithm. A check is thus carried out as to whether, by means of a further adjustment, a desired effect in the form of an improvement in the effectiveness of the respective algorithm can be achieved. Enabling of the relevant settings can thereby also be carried out asymmetrically, that is, settings are enabled such that they can only follow a particular trend but remain blocked in the reverse direction. By this means, configurations can be realized wherein by means of a single adjusting element, two different algorithms can be simultaneously optimized with one adjustment of suitable input parameters and adapted to the respective auditory situation if the trends to be expected in the settings to be made correspond to the opposite setting directions of the setting element. In this case, again, situation-dependent default settings can be used by identifying the existing auditory situation. Starting from pre-set parameter settings, in this case, for example, an increase or reduction in the noise suppression is only then permitted and/or realized if an actual change of effect above a specified threshold is thereby achieved. The settings to be tested can actually be carried out and, if their effectiveness is too small, reset and blocked. Alternatively, the settings to be tested can be simulated.

If the method steps from FIG. 2 to 4 are combined and repeatedly carried out, then by means of constantly changing the linking of a single variably assignable adjusting element according to the invention to different adjustable parameters during repeated actuation of this adjustable parameter, a plurality of parameters and signal processing algorithms can be optimized in a targeted manner and adapted to an auditory situation. For this purpose, it is not necessary that the hearing aid wearer knows the respective existing linkage. With every actuation, the currently most effective adjustment of a parameter is carried out, wherein the effect of this adjustment is used in the next determination of the algorithm with the greatest effectiveness. The setting of the hearing aid is ended in the prevailing auditory situation when no further adjustment with a predetermined minimum effectiveness can be determined. The method according to the invention consists, in this particularly advantageous case, therein that a quantitative determination of the effectiveness of potential adjustments of parameters is carried out in a prevailing auditory situation and that at least one adjusting element is linked to arrangements, in circuit terms, such that on each actuation of the adjusting element 9, the adjustment that is made is always the one which shows the greatest effectiveness on this actuation of the adjusting element at the moment of the adjustment. This results in the maximum achievable simplification of the setting of a hearing aid and a reduction in the number of necessary adjusting elements.

Advantageously, individual variably assignable adjusting elements can be provided to make settings for intuitively linked groups of parameters or signal processing algorithms. For example, a variably assignable adjusting element can be provided for the inventive setting of all the noise suppression algorithms that are integrated into a hearing aid.

The invention claimed is:

1. An adjustable hearing aid, comprising:

one or more signal processing arrangements having an adjustable parameter that influences the response and amplification characteristics of the hearing aid based on an adjustment;

a testing portion that tests an effectiveness of the one or more signal processing arrangements based on the adjustment of the adjustable parameter in a prevailing auditory situation via a simulation; and an enabling portion that enables the adjustment of the adjustable parameter for those signal processing arrangements having a presence of at least a minimum effectiveness.

2. The adjustable hearing aid as claimed in claim 1, wherein the enabling portion comprises a circuit linking capability for linking the adjustable parameter to from a variably assignable adjusting element to one or more signal processing arrangements based on the minimum effectiveness.

3. The adjustable hearing aid as claimed in claim 1, wherein a plurality of parameters that influence the response and amplification characteristics of the hearing aid are adjustable once the effectiveness of the adjustments to be made has been tested by simulation in the prevailing auditory situation and, given the presence of a minimum effectiveness, the adjustment options of the parameters have been enabled.

4. The adjustable hearing aid as claimed in claim 1, wherein a parameter that influences the effectiveness of algorithms of the one or more signal processing arrangements is adjustable once the effectiveness of the adjustment to be made has been tested by simulation in the prevailing auditory situation and, given the presence of a minimum effectiveness, the adjustment option of the parameter has been enabled.

5. The adjustable hearing aid as claimed in claim 1, wherein the number of adjustable parameters which influence the response and amplification characteristics of the hearing aid exceeds the number of variably assignable adjusting elements that are included, and having capability for quantitative determination of the effectiveness of potential adjustments in the prevailing auditory situation and linking the adjustable parameter from the adjusting elements to the one or more signal processing arrangements, in circuit terms, such that enabled adjustments take place in descending order, depending on their effectiveness.

6. The adjustable hearing aid as claimed in claim 1, wherein a variably assignable adjusting element is included to provide the adjustable parameters to one or more signal processing arrangements.

7. The adjustable hearing aid as claimed in claim 1, wherein a variably assignable adjusting element is included and linkable, in circuit terms, to provide the adjustable parameters which influence the effectiveness of algorithms for noise suppression to the one or more signal processing arrangements.

8. The adjustable hearing aid as claimed in claim 1, wherein at least one of the variably assignable adjusting elements is a one-dimensional adjusting element.

9. The adjustable hearing aid as claimed in claim 1, wherein at least one of the variably assignable adjusting elements is an adjusting element of a remote control unit.

10. A method for adjusting a hearing aid, comprising:

testing the effectiveness of an adjustment parameter on one or more signal processing arrangements by simulation in the prevailing auditory situation, the parameter having an influence on the response and amplification characteristics of the hearing aid;

enabling an adjustment option of the parameter for those signal processing arrangements having the presence of a minimum effectiveness; and adjusting at least one parameter which has an influence on the response and amplification characteristics of the hearing aid, provided the testing and the enablement has occurred.

11. The method as claimed in claim 10, wherein a plurality of parameters that influence the response and amplification characteristics of the hearing aid are adjusted once the effectiveness of the adjustments has been tested by simulation in the prevailing auditory situation and, given the presence of a minimum effectiveness, the adjustment options of the parameters which show a minimum effectiveness have been enabled.

12. The method as claimed in claim 10, wherein a plurality of parameters that influence the effectiveness of algorithms of one or more signal processing arrangements are adjusted once the effectiveness of the adjustments has been tested by simulation in the prevailing auditory situation and, given the presence of a minimum effectiveness, the adjustment options of the parameters which show a minimum effectiveness have been enabled.

13. The method as claimed in claim 10, wherein an auditory situation is analyzed and/or classified and settable parameters which influence the response and/or amplification characteristics of the hearing aid are set to starting values belonging to this auditory situation and is subsequently adjusted when the effectiveness of the adjustments has been tested by simulation in the prevailing auditory situation and, given the presence of a minimum effectiveness, the adjustment options of the parameters which show a minimum effectiveness have been enabled.

14. The method as claimed in claim 10, wherein the adjustments made to the parameters are recorded and the settings of the parameters are used as starting values to which the adjustable parameters are set if, at a later time point, an auditory situation is recognized which is characterized by similar acoustic features to, or the same classification as, the auditory situation in which the adjustments were made.

15. The method as claimed in claim 10, wherein a quantitative determination of the effectiveness of potential adjustments of parameters is carried out in a prevailing auditory situation and at least one adjustable parameter of the adjusting element is linked to one or more signal processing arrangements, in circuit terms, such that adjustments which have been enabled, and which can be carried out via the respective adjusting element, are performed in descending order, depending on their effectiveness.

16. The method as claimed in one of claim 10, wherein a quantitative determination of the effectiveness of potential adjustments of parameters in a prevailing auditory situation is carried out and at least one adjustable parameter of the adjusting element is linked to one or more signal processing arrangements, in circuit terms, such that on each actuation of the adjusting element, it is always the adjustment which shows the greatest effectiveness at the moment of the adjustment, on this actuation of the adjusting element, which is carried out.

17. The method as claimed in claim 10, wherein the adjustment of the parameter is smoothed over time.

* * * * *